US009060604B2

(12) United States Patent
Salice

(10) Patent No.: US 9,060,604 B2
(45) Date of Patent: Jun. 23, 2015

(54) DEVICE AND METHOD FOR LATERALLY CENTRING A DRAWER OR THE LIKE ON A PULL-OUT GUIDE AND A HOOKING DEVICE PROVIDED WITH THE DEVICE

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 0 days.

(21) Appl. No.: 13/879,893

(22) PCT Filed: Aug. 31, 2012

(86) PCT No.: PCT/EP2012/066954

§ 371 (c)(1),
(2), (4) Date: Apr. 17, 2013

(87) PCT Pub. No.: WO2013/034494

PCT Pub. Date: Mar. 14, 2013

(65) Prior Publication Data

US 2014/0175965 A1 Jun. 26, 2014

(30) Foreign Application Priority Data

Sep. 8, 2011 (IT) ..... MI2011A1628

(51) Int. Cl.
*A47B 88/04* (2006.01)

(52) U.S. Cl.
CPC ..... *A47B 88/04* (2013.01); *Y10T 29/49826* (2015.01); *A47B 2210/0054* (2013.01); *A47B 88/0422* (2013.01)

(58) Field of Classification Search
CPC ..... A47B 88/047; A47B 88/0422; A47B 2210/0054; A47B 2210/0097; A47B 2210/0032
USPC ..... 312/334.1, 334.4, 334.5, 334.6, 334.7, 312/348.1
See application file for complete search history.

(56) References Cited

U.S. PATENT DOCUMENTS

| | | | | |
|---|---|---|---|---|
| 7,708,358 | B2 * | 5/2010 | Embacher | 312/333 |
| 8,056,994 | B2 * | 11/2011 | Chen et al. | 312/334.6 |
| 8,220,884 | B2 * | 7/2012 | Berger | 312/334.4 |
| 8,336,973 | B2 * | 12/2012 | Berger | 312/334.4 |
| 8,585,165 | B2 * | 11/2013 | Liang et al. | 312/334.4 |
| 2004/0095047 | A1 * | 5/2004 | Salice | 312/332.1 |

(Continued)

FOREIGN PATENT DOCUMENTS

| | | |
|---|---|---|
| DE | 8802690 | 4/1988 |
| WO | WO2004/110213 | 12/2004 |

(Continued)

OTHER PUBLICATIONS

International Search Report and Written Opinion; International Application No. PCT/EP2012/066954; International Filing Date: Aug. 31, 2012; 9 pages.

*Primary Examiner* — Daniel Rohrhoff
(74) *Attorney, Agent, or Firm* — Blank Rome LLP

(57) ABSTRACT

The device (10) for laterally centring a drawer (13) or the like on a pull-out guide (11) comprises a first and a second coupling part (26, 27) respectively connectable to a hooking device (12) for fastening the drawer (13) and to the pull-out guide (11); at least one of the coupling parts (26, 27) is conformed with elastically yieldable means in a lateral direction for causing a forced engagement and/or a shape engagement between the coupling parts (26, 27) such as to compensate for any lateral play between the hooking device (12) and the pull-out guide (11).

12 Claims, 4 Drawing Sheets

(56) References Cited

U.S. PATENT DOCUMENTS

| | | | | |
|---|---|---|---|---|
| 2009/0167128 | A1* | 7/2009 | Berger | 312/334.4 |
| 2012/0217857 | A1* | 8/2012 | Grabherr | 312/334.1 |
| 2012/0319548 | A1* | 12/2012 | Netzer | 312/334.1 |
| 2013/0257244 | A1* | 10/2013 | Salice | 312/319.1 |
| 2014/0015390 | A1* | 1/2014 | Grabherr | 312/334.4 |

FOREIGN PATENT DOCUMENTS

| | | |
|---|---|---|
| WO | WO2006/034820 | 4/2006 |
| WO | WO2007/074077 | 7/2007 |

* cited by examiner

DEVICE AND METHOD FOR LATERALLY CENTRING A DRAWER OR THE LIKE ON A PULL-OUT GUIDE AND A HOOKING DEVICE PROVIDED WITH THE DEVICE

FIELD OF THE INVENTION

The invention relates to a device and a method for laterally centring a drawer or the like on a pull-out guide, and also concerns a hooking device for fixing the drawer to the pull-out guide having the centring device, the hooking device being of a type applicable to the drawer and exhibiting a hooking member insertable in a mounting position in a hole provided in the pull-out guide.

BACKGROUND OF THE INVENTION

The use is known of hooking devices for rapid fixing of drawers and the like to pull-out guides, which devices, which are applicable on a lower side of the drawers, exhibit a manually-commandable hooking member which in the mounting position inserts in a hole provided on a side of the pull-out guides.

For a reciprocal positioning in a lateral direction between the hooking device and the pull-out guide, the device can further exhibit a centring element, having for example a U-section, engageable with a part of the pull-out guide.

However, owing to the inevitable dimensional tolerances and plays between the various parts, the lateral alignment of the drawer on the guides can be imprecise, leading to the problem that the front sides of the drawer, once mounted, might be displaced sideways with respect to one another.

Again owing to lateral play, the engagement of the device to the pull-out guide can further be unstable, with the risk of possible subsequent unhooking of the drawer, for example in over-stressing conditions when the drawer is pulled out to its maximum.

Further, in a case of considerable differences between the interaxis of the centring elements of the hooking device and the interaxis of the extraction guides, during the hooking-up of the drawer to the extraction guides, jamming or breakage of the centring elements are possible, which apart from causing problems in mounting also lead to the possibility of having to replace the broken devices.

Lastly, in a case in which the engagement devices comprise a lateral adjustment step of the drawer, the presence of lateral play reduces the effectiveness and precision of the lateral adjustment itself.

There is therefore a need for a device for lateral centring of a drawer or the like on a pull-out guide, as well as a hooking device of the type under consideration, provided with the centring device, which enable obviating the above-mentioned problems and which at the same time are constructionally simple and easy to mount.

SUMMARY OF THE INVENTION

The main aim of the present invention is therefore to provide a device for laterally centring a drawer or the like on a pull-out guide, in the specific case provided on a hooking device of a type applicable to the drawer for fixing thereof to a pull-out guide, which is constructionally simple and which enables a correct and precise positioning of the drawers in the lateral direction, in particular in a case where a lateral adjustment of the drawers is comprised.

A further aim of the present invention is to provide a device for lateral centring and a hooking device of the type under consideration, which enable a simple mounting of the drawers, without jamming and breakage, and which enable maintaining a stable and reliable coupling of the drawers.

The above-described is attained by means of a device for laterally centring a drawer or the like on a pull-out guide premountable on a body of an article of furniture, the drawer being fixable to the pull-out guide by means of a hooking device fixable to the drawer and exhibiting an hooking member that is insertable in the mounting position in a hole provided in the extractable part of the pull-out guide, the centring device comprising a first and a second coupling part connectable respectively to the hooking device and said pull-out guide, characterised in that at least one of said coupling parts is conformed with elastically yieldable means in a lateral direction in order to cause a forced and/or shape engagement between said coupling parts so as to compensate for any lateral play there might be between the hooking device and the pull-out guide.

The invention further discloses a method for laterally centring a drawer or the like on a pull-out guide premountable on a body of an article of furniture, the drawer being fixable to the pull-out guide by means of a hooking device, characterised by comprising the steps of connecting a first coupling part to the hooking device, connecting a second coupling part to the pull-out guide, and causing a forced and/or shape engagement between said first and second coupling part by subjecting at least one of them to an elastic deformation in a lateral direction so as to compensate for any lateral play between the hooking device and the pull-out guide. Further characteristics of the present invention are also defined in the following claims.

The characteristics and advantages of the present invention will more fully emerge from the following description of a preferred but not exclusive embodiment of the device for laterally centring a drawer or the like on a pull-out guide, and of the hooking device provided therewith, with reference to the accompanying drawings, in which:

DETAILED DESCRIPTION OF THE INVENTION

Figure 1:
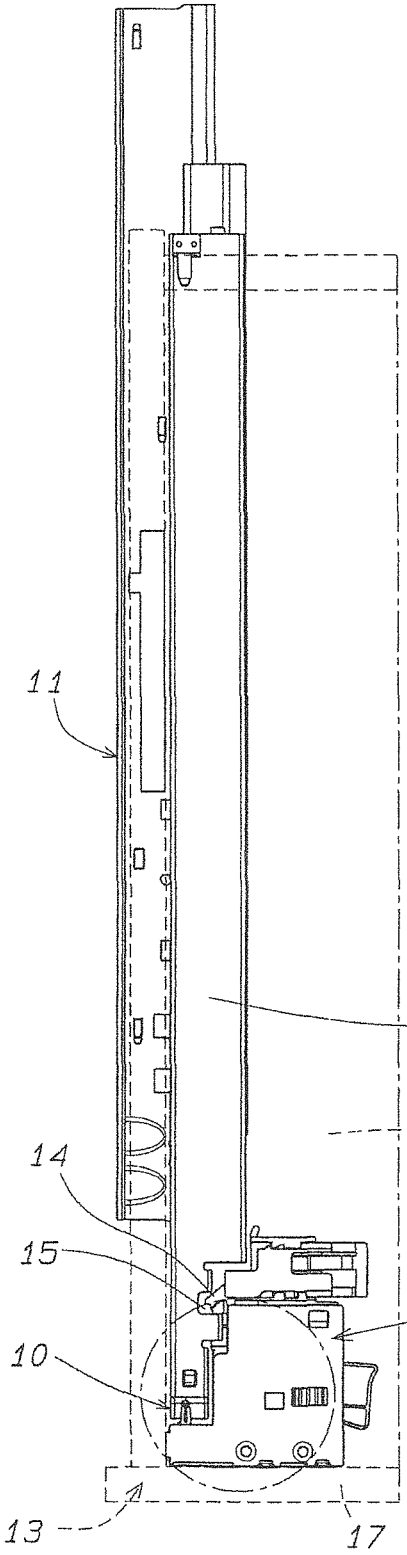
FIG. 1 is a view from above of a pull-out guide with a schematically-represented drawer mounted on the guide by means of a hooking device provided with a centring device according to the present invention.
Figure 2:
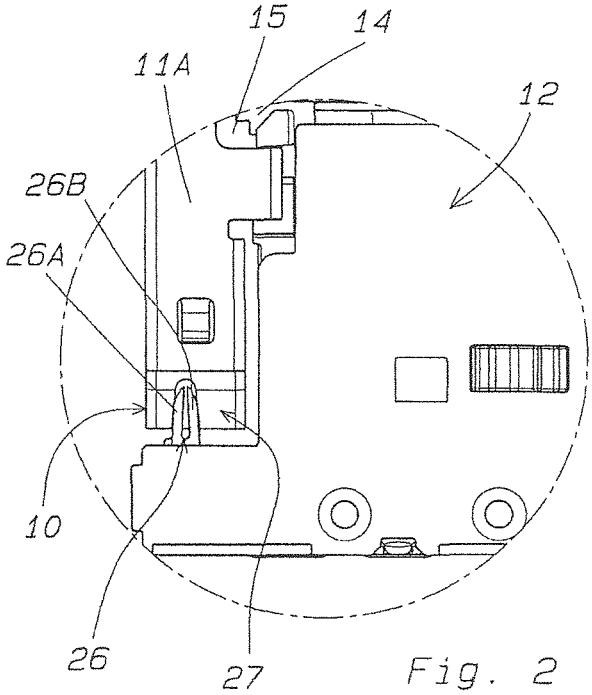
FIG. 2 is an enlarged detail of FIG. 1.
Figure 3:
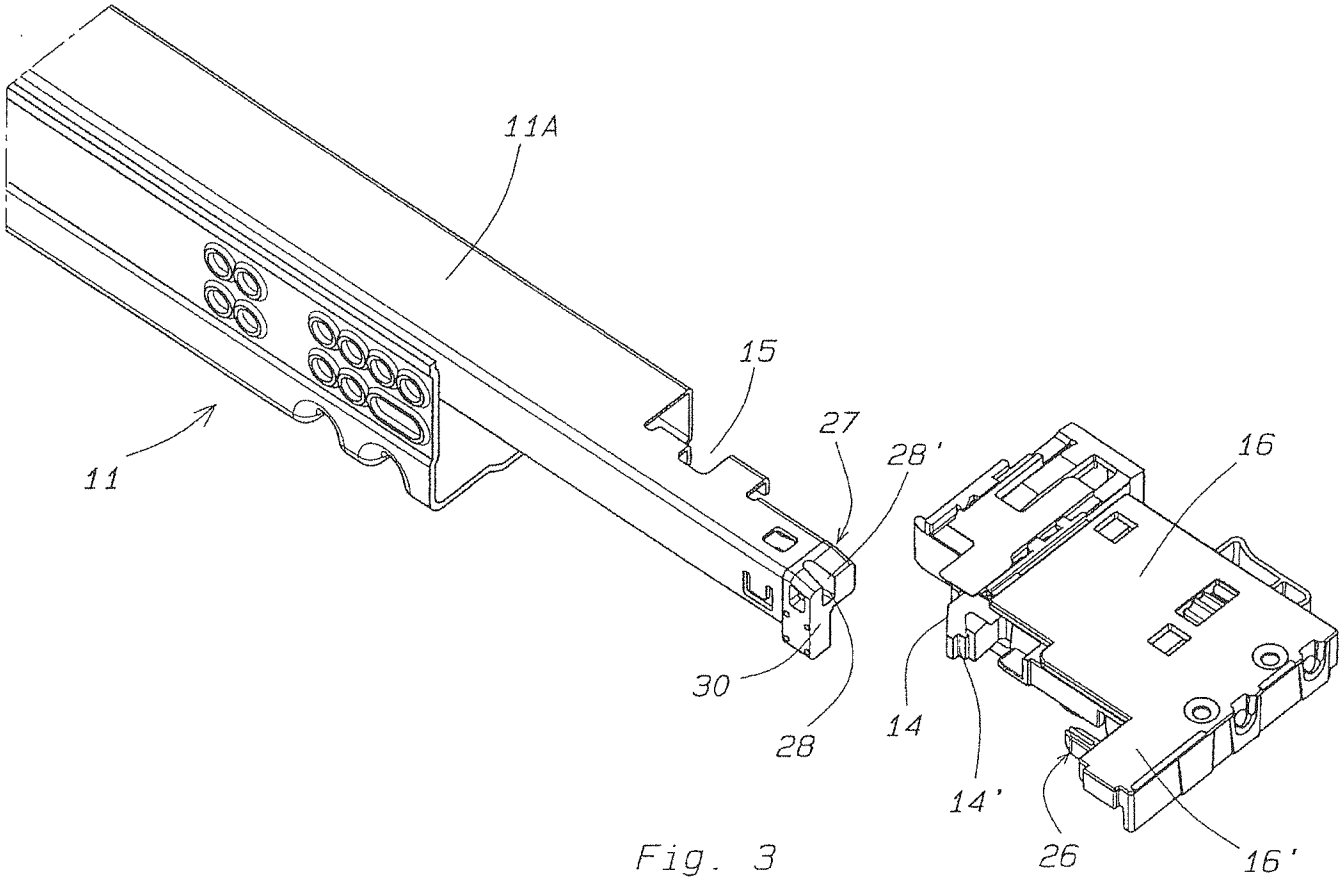
FIG. 3 is an exploded perspective view from above of a hooking device for fastening a drawer and a pull-out guide, in which the centring device according to the present invention is provided.
Figure 4:
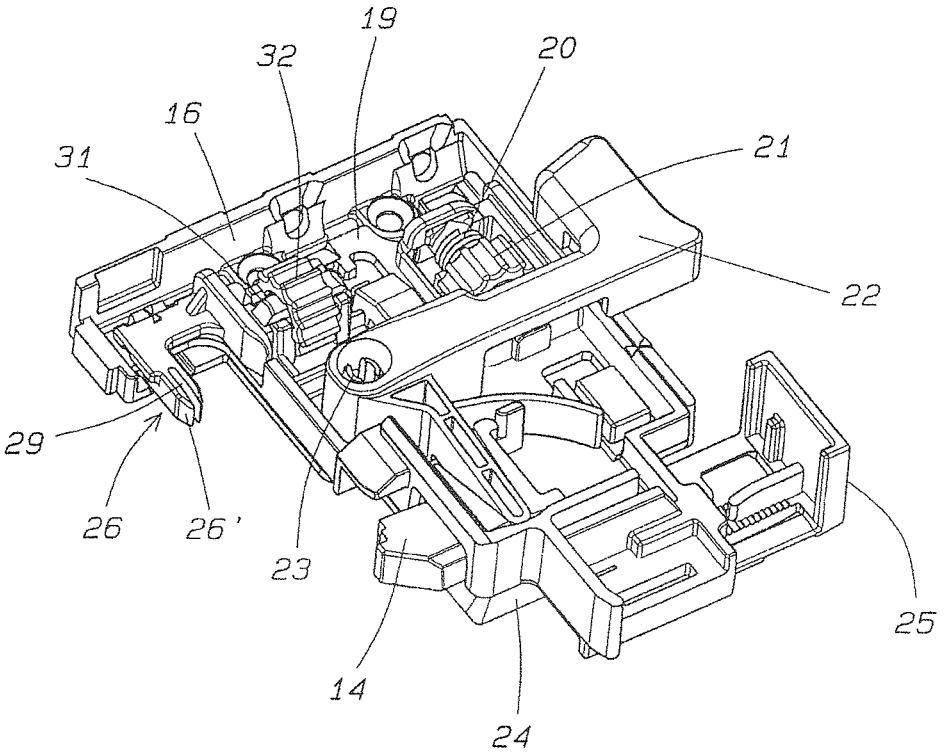
FIG. 4 is a perspective view from below of the hooking device provided with a coupling part of the centring device according to the present invention.
Figure 5:
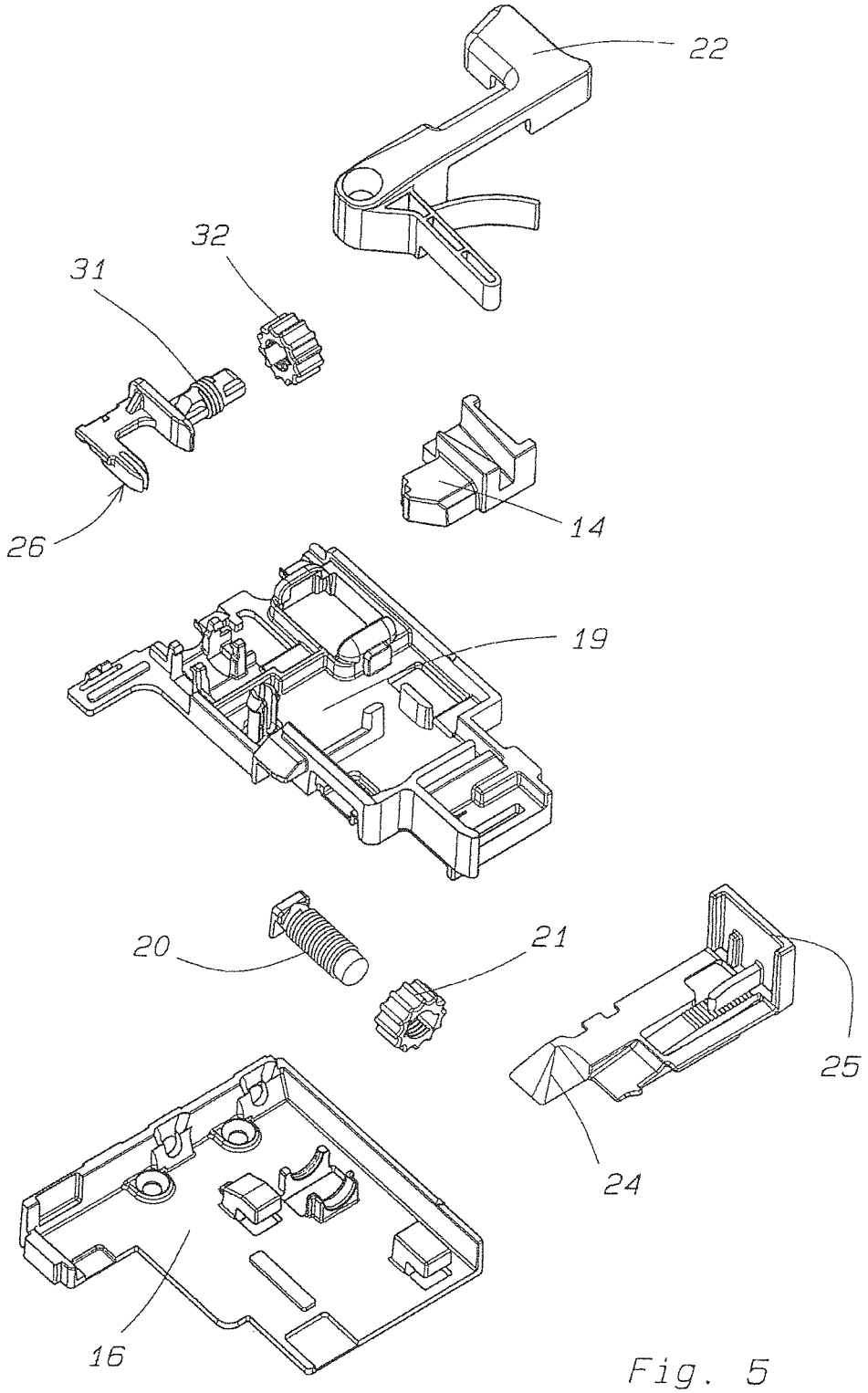
FIG. 5 is an exploded perspective view from below of the hooking device of FIG. 4.

The figures illustrate a lateral centring device for drawers or the like according to the present invention, denoted in its entirety by reference numeral 10, which centring device is arranged between an extractable part 11A of a pull-out guide 11 for drawers, premountable on the body of an article of furniture, and a hooking device 12 of a type which can be fixed to the drawer 13 and having a hooking member 14 insertable in the mounting position in a hole 15 provided in the extractable part 11A of the guide.

In particular, the hooking device 12 exhibits a body comprising a first part of the body 16 that is fixable to the front wall 17 or to the bottom 18 of the drawer 13, for example by means of screws, as well as a second body part 19 slidably connected to the first part of body 16 and adjustable with respect thereto in the longitudinal extraction direction of the drawer 13 by adjusting means, for example comprising a longitudinal screw 20 connected to the second part 19 of the body and a nut 21, manually commandable, rotatably supported but not axially displaceable from the first part 16 of the body.

The above-mentioned hooking member 14, for example in the form of a cursor having a stepped engagement end 14' to allow a selective engagement with the hole 15 of the guide 11 such as to take up at least part of the longitudinal play, is borne slidingly transversally by the second part 19 of the body such as to protrude on a side of the hooking device 12 destined to be directed towards the pull-out guide 11. For the purposes of a manual actuation of the hooking member 14, a lever 22 is for example provided oscillating around a pin 23 which extends from the second part 19 of the body.

The hooking device 12 also comprises adjusting means of the height of the drawer, for example in the form of a wedge element 24 borne slidingly transversally by the second part 19 of the body and manually controllable by a gripping lug 25.

As mentioned, the lateral centring device 10 of the present invention is arranged between the extractable part 11A of the guide and the hooking device 12.

Specifically, the centring device 10 comprises a first coupling part 26 connectable to the hooking device 12 and a second coupling part 27 connected to the extractable part 11A of the guide, which are engageable with each other.

According to the present invention, at least one of the coupling parts 26, 27 is shaped with elastically yieldable means in a lateral direction to cause a forced and/or shape engagement between the coupling parts themselves that is such as to compensate for any play and lateral misalignment between the hooking device 12 and the removable part 11A of the guide 11.

In the illustrated embodiment, the coupling part provided with elastically yieldable means in a lateral direction is the first coupling part 26 connected to the hooking device 12; however, the coupling part provided with the elastically yieldable means might instead be the second coupling part 27 connected to the extractable part 11A of the guide.

The coupling part provided with elastically yieldable means preferably comprises a wedge-shaped centring element 26 which extends from the hooking device 12 along the longitudinal axis of extraction, while the second coupling part 27 comprises an engagement seat 28 for the centring element 26 oriented correspondingly thereto.

The centring element 26 and the relative engagement seat 28 are arranged in such a way as to be oriented substantially in alignment with each other when the drawer 13 is mounted on the pull-out guides 11, except for any play and constructional tolerances. In particular, in the illustrated embodiment, the centring element 26 extends at a lateral projection 16' of the first part of body 16.

Thanks to the elastic yielding of the centring element 26, any significant misalignment of the coupling parts of the hooking device 12 and the pull-out guide 11 are effectively compensated-for, thus preventing jamming and breakage of the coupling parts themselves.

In order to obtain the laterally-directed elastic yielding of the invention, the centring element 26 has a central longitudinal slit 29 which extends along a vertical plane; in this way, the centring element 26 is forked with two longitudinal arms 26A, 26B spaced apart and elastically yieldable in a lateral direction.

The engagement seat 28 has slanted lateral surfaces 28' diverging towards the front end of the extractable part 11A of the guide, which cooperate with the slanted lateral surfaces 26' of the wedge element 26 such as to cause a lateral elastic yielding of the arms 26A, 26B such as to achieve the forced and/or shape engagement between the centring element 26 and the seat 28 itself, necessary for compensating for the play and lateral misalignment between the hooking device 12 and the extractable part 11A of the guide 11.

The slanted surfaces 26' preferably extend only over a tract at the end of the centring element 26, convergingly towards the end, with a greater angle than the slanted surfaces 28' of the seat 28 in reference to the longitudinal axis.

The second coupling part 27 with the engagement seat 28 is preferably provided on an added part 30, for example made of a plastic material, fixable to a front end of the extractable part 11A of the extraction guide 11.

The first coupling part 26 is connectable to the hooking device 12, for example by being made in a single piece with the second part 19 of the body, or according to a preferred embodiment illustrated in the figures, by connecting the centring element 26 to lateral adjustment means of the drawer preferably provided on the hooking device 12.

As illustrated, said lateral adjustment means of the drawer may for example comprise a threaded pin 31 integral with the coupling part 26 and a drive female thread 32 supported in a rotatable but not axially movable by the second body part 19 of the hooking device 12.

When the coupling parts 26, 27 of the centring device 10 are engaged with one another, the adjustment means enable transversally nearing or distancing the hooking device 12 and the guide 11 to and from one another, causing a lateral displacement of the drawer.

Moreover, the presence of the elastic yieldability of the centring element 26 enables a lateral adjustment of the drawer which is immediate and precise, thanks to the compensation of the lateral play according to the invention.

The lateral adjustment means might however be differently shaped.

From the foregoing it is evident that thanks to the centring device of the invention it is possible to achieve a precise positioning of the drawer on the guides in the lateral direction and a high stability of the coupling of the hooking device to the pull-out guide, avoiding the risk of possible unhooking of the drawer, for example in conditions of increased stress during opening.

The centring device according to the invention is however susceptible to modifications and variations falling within the scope of the inventive concept. Furthermore, the constructional details can be replaced by technically equivalent elements.

The invention claimed is:

1. Centring device for laterally centring a drawer, the centring device comprising:

a pull out guide pre-mountable to a body of a piece of furniture, the pull out guide including an extractable part having a hole; and a hooking device fixable to a drawer, where the drawer is fixable to the pull out guide by the hooking device, the hooking device having a hooking member insertable in a mounting position in the hole of the extractable part and a lever for the manual actuation of the hooking member between a hooking position in which the hooking member can engage in the hole of the extractable part and a release position in which the hooking member is disengaged from the hole of the extractable part; and a first and a second coupling part respectively connectable to the hooking device and to the pull-out guide, wherein at least one of the first and the second coupling parts is conformed with an elastic yieldable device, the elastic yieldable device providing yieldability in lateral direction to allow a forced or a shaped engagement between the first and the second coupling parts, the forced or shaped engagement compensating for any lateral play between the hooking device and the pull-out guide.

2. The centring device of claim 1, wherein the elastic yieldable device of the first and the second coupling parts includes a wedge-shaped centring element connectable to one of the hooking device and the pull-out guide, and an engagement seat for receiving the wedge-shaped centring element on the other of the hooking device and the pull-out guide.

3. The centring device of claim 2, wherein the centring element is fork-shaped having two longitudinal arms spaced apart by a central longitudinal slit, the two longitudinal arms being elastically yieldable in lateral direction.

4. The centring device of claim 2, wherein the wedge-shaped centring element extends from the hooking device according to a longitudinal pull-out axis of the pull out guide.

5. The centring device of claim 2, wherein the engagement seat has slanted side surfaces diverging towards a front end of the pull out guide which cooperate with slanted side surfaces of the wedge-shaped centring element to cause the lateral elastic yieldability.

6. The centring device of claim 5, wherein the slanted side surfaces of the wedge-shaped centring element extend only on a part at an end of the centring element, converging towards the same end, with an angle greater than that of the slanted side surfaces of the engagement seat in reference to a respective longitudinal axis.

7. The centring device of claim 2, wherein the centring element and the engagement seat are conformed and arranged to be oriented substantially axially aligned relative to each other in a mounting condition of the drawer.

8. The centring device of claim 2, wherein the second coupling part is provided in an added part fixable to a front end of the pull-out guide.

9. The centring device of claim 2, wherein the first coupling part is connectable to the hooking device by a lateral adjustment device.

10. The centring device of claim 9, wherein the lateral adjustment device includes a threaded pin integral with the first coupling part and a drive female thread supported in a rotatable, but not axially movable, way by a body of the hooking device.

11. Hooking device for fixing a drawer to a longitudinal pull out guide pre-mountable to a body of a piece of furniture, the hooking device comprising:

a body fixable to a drawer;

a hooking member insertable in a hole provided in the pull out guide;

a lever for the manual actuation of the hooking member between a hooking position in which the hooking member can engage in the hole provided in the pull out guide and a release position in which the hooking member is disengaged from the hole provided in the pull out guide; and a first coupling part having a wedge-shaped centring element connectable thereto, where the centring element is fork-shaped having two longitudinal arms spaced apart by a central longitudinal slit, the two longitudinal arms being elastically yieldable in lateral direction to allow a forced or a shaped engagement between the first coupling part and the pull out guide, the forced or shaped engagement compensating for any lateral play between the hooking device and the pullout guide.

12. A method for laterally centring a drawer on a pull out guide, the method comprising the steps of:

pre-mounting a pull out guide on a body of a piece of furniture, the pull out guide comprising a hole; and connecting a drawer to the pull-out guide by a hooking device comprising a hooking member and a lever, the lever configured for providing manual actuation of the hooking member between a hooking position in which the hooking member can engage in the hole of the pull out guide and a release position in which the hooking member is disengaged from the hole of the pull out guide, wherein the step of connecting comprises the steps of:

attaching a first coupling part to the hooking device;

attaching a second coupling part to the pull out guide; and causing a forced or shaped engagement between the first and the second coupling parts by subjecting at least one of the first and the second coupling parts to an elastic deformation in a lateral direction so as to compensate any lateral play between the hooking device and the pull out guide.

* * * * *